US010811175B2

(12) United States Patent
Luo et al.

(10) Patent No.: US 10,811,175 B2
(45) Date of Patent: Oct. 20, 2020

(54) ALLOY MATERIAL, BONDED MAGNET, AND MODIFICATION METHOD OF RARE-EARTH PERMANENT MAGNETIC POWDER

(71) Applicant: GRIREM ADVANCED MATERIALS CO., LTD., Beijing (CN)

(72) Inventors: Yang Luo, Beijing (CN); Chao Yuan, Beijing (CN); Kuo Men, Beijing (CN); Ningtao Quan, Beijing (CN); Hongbin Zhang, Beijing (CN); Wenlong Yan, Beijing (CN); Dunbo Yu, Beijing (CN); Yuanfei Yang, Beijing (CN)

(73) Assignee: GRIREM ADVANCED MATERIALS CO., LTD., Beijing (CN)

( * ) Notice: Subject to any disclaimer, the term of this patent is extended or adjusted under 35 U.S.C. 154(b) by 356 days.

(21) Appl. No.: 15/796,153

(22) Filed: Oct. 27, 2017

(65) Prior Publication Data

US 2018/0182517 A1 Jun. 28, 2018

(30) Foreign Application Priority Data

Dec. 22, 2016 (CN) ..... 2016 1 1199983

(51) Int. Cl.

| | |
|---|---|
| ***H01F 1/055*** | (2006.01) |
| ***B22F 9/04*** | (2006.01) |
| ***C22C 33/02*** | (2006.01) |
| ***C22C 1/04*** | (2006.01) |
| ***H01F 1/057*** | (2006.01) |
| ***C22C 1/03*** | (2006.01) |
| ***C22C 28/00*** | (2006.01) |
| ***C22C 38/00*** | (2006.01) |
| ***C22C 38/10*** | (2006.01) |

(52) U.S. Cl.

CPC ..... *H01F 1/0558* (2013.01); *B22F 9/04* (2013.01); *C22C 1/03* (2013.01); *C22C 1/04* (2013.01); *C22C 28/00* (2013.01); *C22C 33/0278* (2013.01); *C22C 38/005* (2013.01); *C22C 38/10* (2013.01); *H01F 1/0578* (2013.01); *B22F 2009/048* (2013.01); *B22F 2201/013* (2013.01); *B22F 2201/11* (2013.01); *B22F 2301/355* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2013/0009736 | A1* | 1/2013 | Honkura | B22F 1/025 335/302 |
| 2013/0068992 | A1* | 3/2013 | Hono | C21D 6/00 252/62.55 |
| 2018/0025819 | A1* | 1/2018 | Shigemoto | B22F 3/24 419/23 |

FOREIGN PATENT DOCUMENTS

| | | | | |
|---|---|---|---|---|
| CN | 1345073 | A | 4/2002 | |
| WO | WO-2016133071 | A1 * | 8/2016 | B22F 3/24 |

* cited by examiner

*Primary Examiner* — Xiaowei Su

(74) *Attorney, Agent, or Firm* — Shumaker, Loop & Kendrick, LLP; James D. Miller

(57) ABSTRACT

An alloy material, a bonded magnet, and a modification method of a rare-earth permanent magnetic powder are provided by the present application. A melting point of the alloy material is lower than 600° C. and a composition of the alloy material by an atomic part is $RE_{100-x-y}M_xN_y$, wherein RE is one or more of non-heavy rare-earth Nd, Pr, Sm, La and Ce, M is one or more of Cu, Al, Zn and Mg, N is one or more of Ga, In and Sn, x=10-35 and y=1-15.

10 Claims, No Drawings

ALLOY MATERIAL, BONDED MAGNET, AND MODIFICATION METHOD OF RARE-EARTH PERMANENT MAGNETIC POWDER

CROSS REFERENCE TO RELATED PATENT APPLICATION

This patent application claims priority to Chinese Patent Application No. 201611199983.1 filed Dec. 22, 2016, the entire disclosure of which is hereby incorporated herein by reference.

FIELD OF THE INVENTION

The present application relates to the field of rare-earth material preparation, and more particularly, to an alloy material, a bonded magnet, and a modification method of a rare-earth permanent magnetic powder.

BACKGROUND OF THE INVENTION

The rare-earth permanent magnetic material is prepared by means of a certain process from an alloy formed by a rare-earth metal and a transition metal and is an important basic material supporting the development of modern industrial society. The rare-earth permanent magnet represented by neodymium-iron-boron is a permanent magnetic alloy with the highest application property at present and has been developed into three types (sintered, bonded and hot pressed) of the rare-earth permanent magnetic materials. Along with the expansion of the neodymium-iron-boron applied range and the increase of demand, the expectations for the properties of a neodymium-iron-boron alloy are increasingly improved. A magnetic energy product and a coercivity are two evaluation indexes most important to the permanent magnetic material. Currently, the magnetic energy product of the neodymium-iron-boron alloy material applied is close to its theoretical maximum magnetic energy product, but the coercivity still is far from its theoretical maximum value. Due to the low coercivity of the permanent magnetic material, the stability of the magnet becomes poor, particularly in some special application environments with a varying temperature, and the magnetic property of the magnet will be attenuated quickly. Hence, to improve the coercivity is an effective method for improving the high temperature property and the temperature stability of the magnet.

For the $Nd_2Fe_{14}B$ or $Pr_2Fe_{14}B$ rare-earth permanent magnetic alloy, to improve the coercivity, it requires starting from an anisotropic field of main phase grains. For example, the coercivity may be increased by adding heavy rare-earth Dy, Tb to substitute Nd or Pr in an alloy smelting process, which lies in that the formed $(Dy, Tb)_2Fe_{14}B$ phase has a larger anisotropic field. However, by virtue of the method for substituting the Nd or the Pr with the heavy rare-earth Dy, Tb, the magnetic energy product will be obviously reduced. On the other hand, it requires starting from grain boundary diffusion of the heavy rare-earth Dy, Tb. The coercivity is improved by increasing an anti-magnetization domain nucleation field nearby a grain boundary or by decreasing the ferromagnetism of the grain boundary to reduce magnetic exchange coupling of adjacent grains. For example, the Aichi Steel in Japan improves the coercivity of the magnetic powder and further improves its service temperature and thermostability by employing hydride diffusion Dy on a surface (CN1345073A) of the anisotropic HDDR neodymium-iron-boron magnetic powder. Although the heavy rare-earth Dy, Tb and the like are used, the coercivity is improved obviously by means of methods of substitution or grain boundary diffusion. However, the above methods have the problems of shortage in heavy rare-earth resources and high cost, etc.

Non-heavy rare-earth grain boundary diffusion achieves the purpose of improving the coercivity of the magnetic powder by means of permeating a low-melting-point alloy composed of non-heavy rare earths and other alloy elements to a grain boundary area of neodymium-iron-boron main phase grains to reduce or block the magnetic exchange coupling. Through the non-heavy rare-earth grain boundary diffusion, for instance, the diffusion of PrCu, NdCu alloys on the surface of hot pressed and sintered block magnets, the coercivity may be improved significantly, the high-coercivity magnet with no heavy rare earth added is realized and the service property of the magnet is improved. For a bonded magnet, in some special application environments, there also exists the problem of attenuation in the magnetic property, so to improve the coercivity is also an important method to improve the magnetic stability. However, the grain boundary diffusion is less applied on the bonded magnet, which mainly lies in the grain boundary diffusion is acted on a bonded magnetic powder, so while the coercivity of the magnetic powder is improved, the other index (magnetic energy product) is reduced obviously (Zhong Lin, Jingzhi Han, Shunquan Liu, et al. Journal of Applied Physics 2012, 111: 07A722). Furthermore, the bonded magnet is highly demanding on the uniformity of the magnetic powder, whereas the grain boundary diffusion has the problems of non-uniform diffusion and the like, thereby being not beneficial to promotion. Besides, the high-performance magnetic powder further requires the structural characteristic of fine grains. However, the diffusion effect of the related art at a relatively low temperature is unsatisfactory, it is easy to cause the grain growth due to a long-time treatment at a high temperature and the magnetic property of the magnetic powder also will be reduced.

SUMMARY

The present application is mainly intended to provide an alloy material, a bonded magnet, and a modification method of a rare-earth permanent magnetic powder, so as to solve the problem that the high temperature property of the magnet in the related art is relatively poor.

To this end, according to one aspect of the present application, the alloy material is provided. A melting point of the alloy material is lower than 600° C. and a composition of the alloy material by an atomic part is $RE_{100-x-y}M_xN_y$, wherein RE is one or more of non-heavy rare-earth Nd, Pr, Sm, La and Ce, M is one or more of Cu, Al, Zn and Mg, N is one or more of Ga, In and Sn, x=10-35 and y=1-15.

Further, the alloy material is an alloy powder, and preferably, the granularity of the alloy powder is 160-40 μm.

According to another aspect of the present application, the modification method of a rare-earth permanent magnetic powder is provided. The modification method includes: step S1, mixing any one of the above alloy materials with a rare-earth permanent magnetic powder to obtain a mixed powder, wherein a mass proportion of the alloy material in the mixed powder is 1-10%, preferably 2-5%; and step S2, in a first inert atmosphere or a vacuum condition, performing a heat treatment on the mixed powder to obtain a modified rare-earth permanent magnetic powder.

Further, the step S2 includes: step S21, in the first inert atmosphere or the vacuum condition, heating the mixed powder for 5-30 min at 675-900° C. to obtain a pretreated powder; and step S22, heating the pretreated powder for 2-12 h at 500-600° C. to obtain the modified rare-earth permanent magnetic powder.

Further, the alloy material is an alloy powder whose granularity is 160-40 μm, and preferably, the granularity of the rare-earth permanent magnetic powder is 400-50 μm. Further, the vacuum degree of the vacuum state is $10^{-2}$-$10^{-4}$ Pa, and preferably, the inert atmosphere is an argon atmosphere.

Further, before the step S21, the step S2 further includes: heating at a heating rate not less than 15° C./min to 675-900° C.

Further, after the step S21 and before the step S22, the step S2 further includes: cooling at a cooling rate not less than 15° C./min to 500-600° C.

Further, a magnetic main phase of the rare-earth permanent magnetic powder is provided with a $RE'_2Fe_{14}B$ structure, wherein RE' is Nd and/or Pr and parts of the Nd or the Pr therein may be substituted by Dy, Tb, La and/or Ce; a total atomic ratio of rare earths in the rare-earth permanent magnetic powder is 9-12.0%.

Further, the modification method further includes a preparation method of the alloy material, the preparation method includes: weighing each raw material according to the composition of the alloy material, and preparing the each raw material into a master alloy by employing induction smelting or electric arc smelting; preparing the master alloy into alloy sheets by employing a quick-setting sheet casting method or a high-speed rotary quenching method; and crushing the alloy sheets into the alloy powder by employing mechanical crushing or hydrogen crushing in a second inert atmosphere, the granularity of the alloy powder being 160-40 μm, and preferably, the second inert atmosphere being an argon atmosphere.

According to still another aspect of the present application, a bonded magnet is provided. The bonded magnet is prepared from a rare-earth permanent magnetic powder; and the rare-earth permanent magnetic powder is a modified rare-earth permanent magnetic powder obtained with any one of the above modification methods.

By applying the technical solutions of the present application, any one or more of non-heavy rare earths or highly abundant Nd, Pr, Sm, La and Ce rare-earth elements are used in the alloy material, so the cost is relatively low. One or more of non-rare-earth metal elements in Cu, Al, Zn and Mg are added, and meanwhile, by means of a cooperation of contents, a low-melting-point eutectic alloy may be formed and the liquid phase diffusion may be performed on the eutectic alloy at a relatively low temperature. In addition, with an appropriate addition of one or more elements of low-melting-point metals Ga, In and Sn, the melting point of the alloy material can be further reduced and the wettability between the alloy material and the rare-earth permanent magnetic powder is increased, such that the uniformity of diffusing the elements therein to the rare-earth permanent magnetic powder is improved, the low-temperature diffusion is implemented and the damage to the magnetic property of the magnetic powder due to a high-temperature long-time heat treatment may be avoided. At the meantime, the Ga, the In and the Sn further have the obvious grain boundary segregation characteristic in the neodymium-iron-boron alloy, so that the effect of the grain boundary diffusion to improve the coercivity can be enhanced. Therefore, when the above alloy material of the present application is applied to modifying the rare-earth permanent magnetic powder, the diffusion can be performed at the low temperature and the coercivity of the rare-earth permanent magnetic powder can be enhanced, such that the magnet formed by the modified rare-earth permanent magnetic powder has the relatively good high temperature resistance.

DETAILED DESCRIPTION OF THE EMBODIMENTS

It is to be noted that the embodiments of the present application and the characteristics of the embodiments may be combined with each other if there is no conflict. The present application will be described below with reference to the embodiments in detail.

As analyzed in the background, various modification methods to the rare-earth permanent magnetic powder in the prior art all have a certain defects and are difficult to achieve the purposes of being low-cost and improving the high temperature property of the rare-earth permanent magnetic powder. To solve the problem, the present application provides an alloy material, a bonded magnet, and a modification method of the rare-earth permanent magnetic powder.

In a typical embodiment of the present application, an alloy material is provided. A melting point of the alloy material is lower than 600° C. and a composition of the alloy material by an atomic part is $RE_{100-x-y}M_xN_y$, wherein RE is one or more of non-heavy rare-earth Nd, Pr, Sm, La and Ce, M is one or more of Cu, Al, Zn and Mg, N is one or more of Ga, In and Sn, x=10-35 and y=1-15.

Any one or more of non-heavy rare earths or highly abundant Nd, Pr, Sm, La and Ce rare-earth elements are used in the alloy material of the present application, so the cost is relatively low. One or more of non-rare-earth metal elements in Cu, Al, Zn and Mg are added, and meanwhile, by means of a cooperation of contents, a low-melting-point eutectic alloy may be formed and the liquid phase diffusion may be performed on the eutectic alloy at a relatively low temperature. In addition, with an appropriate addition of one or more elements of low-melting-point metals Ga, In and Sn, the melting point of the alloy material can be further reduced and the wettability between the alloy material and the rare-earth permanent magnetic powder is increased, such that the uniformity of diffusing the elements therein to the rare-earth permanent magnetic powder is improved, the low-temperature diffusion is implemented and the damage to the magnetic property of the magnetic powder due to a high-temperature long-time heat treatment may be avoided. At the meantime, the Ga, the In and the Sn further have the obvious grain boundary segregation characteristic in the neodymium-iron-boron alloy, so that the effect of the grain boundary diffusion to improve the coercivity can be enhanced. Therefore, when the above alloy material of the present application is applied to modifying the rare-earth permanent magnetic powder, the diffusion can be performed at the low temperature and the coercivity of the rare-earth permanent magnetic powder can be enhanced, such that the magnet formed by the modified rare-earth permanent magnetic powder has the relatively good high temperature resistance.

The alloy material may be sheets to be stored. To use it conveniently, preferably, the alloy material is an alloy powder, and more preferably, the granularity of the alloy powder is 160-40 μm. With the adoption of the alloy powder, it is beneficial to directly applying it to the modification of the rare-earth permanent magnetic powder.

In another typical embodiment of the present application, a modification method of the rare-earth permanent magnetic powder is provided. The modification method includes: step S1, mixing any one of the above alloy materials with the rare-earth permanent magnetic powder to obtain a mixed powder, wherein a mass proportion of the alloy material in the mixed powder is 1-10%, preferably 2-5%; and step S2, in a first inert atmosphere or a vacuum condition, performing a heat treatment on the mixed powder to obtain a modified rare-earth permanent magnetic powder.

As described above, the alloy material provided by the present application has the characteristic of the low melting point and has the relatively good wettability with the rare-earth permanent magnetic powder, so the liquid phase diffusion may be performed at the relatively low temperature and the damage to the magnetic property of the magnetic powder due to the high-temperature long-time heat treatment may be avoided. In addition, the alloy material contains the Ga, the In and/or the Sn, which further have the obvious grain boundary segregation characteristic in the neodymium-iron-boron alloy, so that the effect of the grain boundary diffusion to improve the coercivity can be enhanced. Therefore, the magnet formed by the modified rare-earth permanent magnetic powder has the relatively good high temperature resistance.

The heat treatment is intended to diffuse the elements in the alloy material to the rare-earth permanent magnetic powder, so the treatment temperature at least is the melting point of the alloy material. To better promote the diffusion of the elements in the alloy material and avoid the influence of the heat treatment temperature to the properties of the rare-earth permanent magnetic powder, preferably, the step S2 includes: step S21, in the first inert atmosphere or the vacuum condition, heating the mixed powder for 5-30 min at 675-900° C. to obtain a pretreated powder; and step S22, heating the pretreated powder for 2-12 h at 500-600° C. to obtain the modified rare-earth permanent magnetic powder.

Specific conditions of the above high-low temperature two-stage diffusion heat treatment process may be adjusted in cooperation with diffusion-alloy components in the above ranges. First of all, at the relatively high temperature, the short-time heat treatment realizes the liquid uniform coating of a diffusion alloy to the rare-earth permanent magnetic powder. Then, at the low temperature, the long-time heat treatment will enable the alloy to uniformly diffuse to grain boundary areas inside the magnetic powder. Therefore, not only is the damage of the high-temperature long-time heat treatment to the magnetic property of the magnetic powder avoided, but also the purpose of the uniform diffusion can be implemented, thereby finally improving the coercivity and the temperature stability and obtaining the modified rare-earth permanent magnetic powder that is uniformly diffused.

The alloy material is molten in a high temperature stage. To achieve the purpose of uniform diffusion and modification, the alloy material is an alloy powder whose granularity is 160-40 μm preferably. Moreover, it is easy to cause non-uniform diffusion in case of too large granularity of the alloy material and to inhale oxygen to oxidize in case of too small granularity. Further preferably, the granularity of the rare-earth permanent magnetic powder is 400-50 μm, so as to implement uniform mixing with the alloy material.

As mentioned above, the alloy material is oxidized easily in case of the too small granularity. In order to prevent it from being oxidized, the vacuum degree of the vacuum condition is $10^{-2}$-$10^{-4}$ Pa preferably, or the inert atmosphere is an argon atmosphere preferably.

In a preferred embodiment of the present application, before the step S21, the step S2 further includes: heating at a heating rate not less than 15° C./min to 675-900° C. By controlling the heating rate, reactants may reach to a preset temperature in a short time, so the structure of the rare-earth permanent magnetic powder is prevented from being affected due to a long-time high temperature. On the premise that the prior art can be implemented, the larger the maximum value of the heating rate is, the better the effect is, thereby implementing rapid heating.

In another preferable embodiment of the present application, after the step S21 and before the step S22, the step S2 further includes: cooling at a cooling rate not smaller than 15° C./min to 500-600° C. By virtue of the above cooling rate, the pretreated powder is quickly cooled to a low temperature and the long-time influence of the high temperature is avoided. On the premise that the related art can be implemented, the larger the maximum value of the cooling rate is, the better the effect is, thereby implementing rapid cooling.

Theoretically, the modification method of the present application may be applied to all types of the rare-earth permanent magnetic powders, particularly to the neodymium-iron-boron rare-earth permanent magnetic powder whose total rare-earth content is lower than or slightly higher than 11.8% which is a total atomic ratio of the rare earths in a hard magnetic main phase $RE'_2Fe_{14}B$. The magnetic main phase of the rare-earth permanent magnetic powder is provided with a $RE'_2Fe_{14}B$ structure, wherein RE' is Nd and/or Pr and parts of the Nd or the Pr therein may be substituted by Dy, Tb, La, Ce; preferably, the total atomic ratio of rare earths in the rare-earth permanent magnetic powder is 9-12.0%. There are fine nano grain systems inside the rare-earth permanent magnetic powder and by the coupling among the nano grains inside the material, the relatively high remanence and magnetic energy product are realized, such that the magnetic property is closely associated with the grain systems. However, the rare-earth content is relatively low, the grain systems are affected by the heat treatment process very easily and the grain growth is caused easily for the long-time high-temperature treatment, so the magnetic property is obviously reduced. By modifying the rare-earth permanent magnetic powder with the alloy material, the purposes of uniformly diffusing and improving the coercivity may be achieved at the relatively low temperature; and meanwhile, the problem of reduced magnetic property due to the long-time high-temperature treatment further may be avoided.

To implement the modification method of the present application conveniently, preferably, the modification method further includes a preparation method of the alloy material. The preparation method includes: weighing each raw material according to the composition of the alloy material, and preparing the each raw material into a master alloy by employing induction smelting or electric arc smelting; preparing the master alloy into alloy sheets by employing a quick-setting sheet casting method or a high-speed rotary quenching method; and crushing the alloy sheets into the alloy powder by employing mechanical crushing or hydrogen crushing in a second inert atmosphere, the granularity of the alloy powder being 160-40 μm, and preferably, the second inert atmosphere being an argon atmosphere. The induction smelting, the electric arc smelting, the quick-setting sheet casting and the high-speed rotary quenching all are common methods in the art; and when they are applied to the present application, their conditions also may be referred to the prior art and will not described more here.

In still another embodiment of the present application, a bonded magnet is provided. The bonded magnet is prepared from a rare-earth permanent magnetic powder; and the rare-earth permanent magnetic powder is a modified rare-earth permanent magnetic powder obtained with any one of the above modification methods. Based on the advantages of the rare-earth permanent magnetic powder of the present application, the magnetic property such as coercivity and the like of the obtained bonded magnet is also excellent at the high temperature, which makes up the problem that the bonded magnet formed by the obtained rare-earth permanent magnetic powder in the prior art has poor high temperature property.

The beneficial effects of the present application will be further described below with reference to the embodiments and the comparative embodiments.

In the embodiments hereinafter, the magnetic property (maximum magnetic energy product BHm and coercivity Hcj) before and after the magnetic powder diffused was detected by employing a vibrating sample magnetometer (VSM). The thermostability was characterized by measuring the flux attenuation of the bonded magnet. The magnetic powder before and after the diffusion were used for manufacturing the bonded magnet respectively, the heat preservation was performed on the magnet for 100 h at 120° C. in an atmospheric environment, and the attenuation of a flux on the surface was measured.

Embodiment 1

A neodymium-praseodymium series $Nd_{7.6}Pr_{2.5}Fe_{84.1}B_{5.8}$ permanent magnetic powder was treated according to the following steps:

1) the raw materials were mixed according to a design composition; a master alloy of a $Nd_{66}Cu_{28}Ga_6$ low-melting-point alloy was prepared by employing vacuum induction smelting; and the obtained master alloy was prepared into a diffusion-alloy quick-quenched ribbon at a quick quenching rate of 25 m/s by employing a high-speed single-roller rotary quenching method, and the diffusion-alloy quick-quenched ribbon was crushed into a powder in an Ar gas protection atmosphere by employing a mechanical grinding method, the $Nd_{66}Cu_{28}Ga_6$ alloy powder whose granularity was 160-40 μm was obtained;
2) a rare-earth permanent magnetic powder whose granularity was 400-50 μm (a total RE atomic ratio was 10.1% and a magnetic main phase was provided with an $RE'_2Fe_{14}B$ structure) was mixed with the $Nd_{66}Cu_{28}Ga_6$ alloy powder mechanically and uniformly to obtain a mixture, a mass fraction of the alloy powder in the mixture being 3%;
3) a two-stage diffusion heat treatment was performed on the mixture in a vacuum condition of $5*10^{-3}$ Pa; the heat treatment process was to quickly heat at a heating rate of 25° C./min to 725° C. and preserve the temperature for 25 min, then quickly cool to 600° C. at a cooling rate of about 20° C./min and continue to preserve the temperature for 5 h at 600° C.; after the diffusion heat treatment was finished, a sample was cooled in the air to a room temperature to obtain the modified rare-earth permanent magnetic powder in the embodiment 1.

Embodiment 2

A Ce-containing praseodymium-neodymium series $Nd_{3.2}Pr_{7.6}Ce_{1.2}Fe_{81.8}B_{6.2}$ permanent magnetic powder was treated according to the following steps:

1) a master alloy of a $Ce_{85}Al_9Mg_3Sn_3$ low-melting-point alloy was prepared by employing vacuum induction smelting; and diffusion-alloy sheets were prepared at 8 m/s in an Ar protection atmosphere by employing a quick-setting sheet casting SC technology and were crushed into a powder mechanically in the Ar gas protection atmosphere by employing a jet milling method, the $Ce_{85}Al_9Mg_3Sn_3$ alloy powder whose granularity was 120-50 μm was obtained;
2) a rare-earth permanent magnetic powder whose granularity was 400-80 μm (a total RE atomic ratio was 12.0% and a magnetic main phase was provided with an $RE'_2Fe_{14}B$ structure) was mixed with the $Ce_{85}Al_9Mg_3Sn_3$ alloy powder mechanically and uniformly to obtain a mixture, a mass fraction of the diffusion-alloy powder in the mixture being 4%;
3) a diffusion heat treatment was performed on the mixture in a vacuum condition of $2*10^{-3}$ Pa; the heat treatment process was to quickly heat at a heating rate of 25° C./min to 775° C. and preserve the temperature for 30 min, then quickly cool to 580° C. at about 20° C./min and continue to preserve the temperature for 6 h at 580° C.; after the diffusion heat treatment was finished, a sample was cooled in the air to a room temperature to obtain the modified rare-earth permanent magnetic powder in the embodiment 2.

Embodiment 3

A Ce and La containing neodymium series $Nd_{7.2}La_{1.5}Ce_{0.3}Fe_{8.4}Nb_{1.2}B_{5.8}$ permanent magnetic powder was treated according to the following steps:

1) a $La_{70}Cu_{29}Sn_1$ low-melting-point alloy was prepared by employing induction smelting; and a diffusion-alloy quick-quenched ribbon was prepared at a quick quenching rate of 20 m/s by employing a single-roller high-speed rotary quenching method and was crushed into a powder in an Ar gas protection atmosphere by employing a mechanical grinding method, the $La_{70}Cu_{29}Sn_1$ alloy powder whose granularity was 160-60 μm was obtained;
2) a rare-earth permanent magnetic powder whose granularity was 300-70 μm (a total RE atomic ratio was 9.0% and a magnetic main phase was provided with an $RE'_2Fe_{14}B$ structure) was mixed with the $Ce_{85}Al_9Mg_3Sn_3$ alloy powder mechanically and uniformly to obtain a mixture, a mass fraction of the diffusion-alloy powder in the mixture being 2%; and
3) a diffusion heat treatment was performed on the mixture in a vacuum condition of $1*10^{-3}$ Pa; the heat treatment process was to quickly heat at a heating rate of 25° C./min to 675° C. and preserve the temperature for 30 min, then quickly cool to 500° C. at about 20° C./min and continue to preserve the temperature for 12 h at 500° C.; after the diffusion heat treatment was finished, a sample was cooled in the air to a room temperature to obtain the modified rare-earth permanent magnetic powder in the embodiment 3.

Embodiment 4

A neodymium series $Nd_{11.3}Fe_{80.8}Co_{2.0}B_5$ rare-earth permanent magnetic powder was treated according to the following steps:

1) a $Nd_{78}Al_{12}Cu_2In_8$ low-melting-point alloy was prepared by employing induction smelting; and a diffusion-alloy quick-quenched ribbon was prepared at a quick quenching rate of 30 m/s by employing a high-speed rotary quenching method and was crushed into a powder in an Ar gas protection atmosphere by employing a mechanical grinding method, the $Nd_{78}Al_{12}Cu_2In_8$ alloy powder whose granularity was 100-40 μm was obtained;

2) the rare-earth permanent magnetic powder whose granularity was 200-80 μm (a total RE atomic ratio was 11.3%) was mixed with the $Nd_{78}Al_{12}Cu_2In_8$ alloy powder mechanically and uniformly to obtain a mixture, a mass fraction of the diffusion-alloy powder in the mixture being 3%; and 3) a diffusion heat treatment was performed on the mixture in a vacuum condition of $5*10^{-3}$ Pa; the heat treatment process was to quickly heat at a heating rate of 30° C./min to 850° C. and preserve the temperature for 10 min, then quickly cool to 560° C. at about 18° C./min and continue to preserve the temperature for 5 h at 560° C.; after the diffusion heat treatment was finished, a sample was cooled in the air to a room temperature to obtain the modified rare-earth permanent magnetic powder in the embodiment 4.

Embodiment 5

A praseodymium series $Pr_{9.3}Fe_{85.2}Nb_{0.2}B_{5.3}$ rare-earth permanent magnetic powder was treated according to the following steps:

1) a master alloy ingot of a $Pr_{66}Zn_{19}Ga_{15}$ low-melting-point alloy was prepared by employing induction smelting; after homogenizing treatment in an Ar gas protection atmosphere, the alloy ingot was prepared into a diffusion-alloy powder by employing a hydrogen crushing method, the $Pr_{66}Zn_{19}Ga_{15}$ alloy powder whose granularity was 120-50 μm was obtained;

2) a rare-earth permanent magnetic powder whose granularity was 300-100 μm (a total RE atomic ratio was 9.3% and a magnetic main phase was provided with an $RE'_2Fe_{14}B$ structure) was mixed with the $Pr_{66}Zn_{19}Ga_{15}$ alloy powder mechanically and uniformly to obtain a mixture, a mass fraction of the diffusion-alloy powder in the mixture being 5%;

3) a diffusion heat treatment was performed on the mixture in a high-purity Ar protection atmosphere; the heat treatment process was to quickly heat at a heating rate of 35° C./min to 900° C. and preserve the temperature for 5 min, then quickly cool to 600° C. at about 30° C./min and continue to preserve the temperature for 2 h at 600° C.; after the diffusion heat treatment was finished, a sample was cooled in the air to a room temperature to obtain the modified rare-earth permanent magnetic powder in the embodiment 5.

Embodiment 6

A neodymium-praseodymium series $Pr_{8.2}Nd_{2.5}Fe_{81.9}Co_{1.5}B_{5.9}$ permanent magnetic powder was treated according to the following steps:

1) a $Pr_{62}Cu_{28}Al_7Ga_3$ low-melting-point alloy was prepared by employing induction smelting; and diffusion-alloy sheets were prepared at 10 m/s by employing a quick-setting sheet casting SC technology and were crushed into a powder mechanically in an Ar gas protection atmosphere by employing a jet milling method, thereby obtaining the $Pr_{62}Cu_{28}Al_7Ga_3$ alloy powder whose granularity was 120-50 μm;

2) a rare-earth permanent magnetic powder whose granularity was 300-50 μm (a total RE atomic ratio was 10.7% and a magnetic main phase was provided with an $RE'_2Fe_{14}B$ structure) was mixed with the $Pr_{62}Cu_{28}Al_7Ga_3$ alloy powder mechanically and uniformly to obtain a mixture, a mass fraction of the diffusion-alloy powder in the mixture being 3%;

3) a two-stage diffusion heat treatment was performed on the mixture in a vacuum condition of $5*10^{-3}$ Pa; the heat treatment process was to quickly heat at a heating rate of 25° C./min to 725° C. and preserve the temperature for 15 min, then quickly cool to 520° C. at about 30° C./min and continue to preserve the temperature for 8 h at 520° C.; after the diffusion heat treatment was finished, a sample was cooled in the air to a room temperature to obtain the modified rare-earth permanent magnetic powder in the embodiment 6.

Embodiment 7

The difference with the embodiment 1 lies in that the granularity of the rare-earth permanent magnetic powder $Nd_{7.6}Pr_{2.5}Fe_{84.1}B_{5.8}$ was 300-500 μm.

Embodiment 8

The difference with the embodiment 1 lies in that the granularity of the $Nd_{66}Cu_{28}Ga_6$ alloy powder was 100-200 μm.

Embodiment 9

The difference with the embodiment 1 lies in that the two-stage diffusion heat treatment was performed in the vacuum condition of 0.02 Pa.

Embodiment 10

The difference with the embodiment 1 lies in that the heat treatment process was to quickly heat at a heating rate of 12° C./min to 725° C. and preserve the temperature for 25 min, then quickly cool to 600° C. at about 20° C./min and continue to preserve the temperature for 5 h at 600° C.; after the diffusion heat treatment was finished, a sample was cooled in the air to a room temperature.

Embodiment 11

The difference with the embodiment 1 lies in that the heat treatment process was to quickly heat at a heating rate of 25° C./min to 650° C. and preserve the temperature for 25 min, then quickly cool to 600° C. at about 20° C./min and continue to preserve the temperature for 5 h at 600° C.; after the diffusion heat treatment was finished, a sample was cooled in the air to a room temperature.

Embodiment 12

The difference with the embodiment 1 lies in that the heat treatment process was to quickly heat at a heating rate of 25° C./min to 725° C. and preserve the temperature for 35 min, then quickly cool to 600° C. at about 20° C./min and continue to preserve the temperature for 5 h at 600° C.; after the diffusion heat treatment was finished, a sample was cooled in the air to a room temperature.

Embodiment 13

The difference with the embodiment 1 lies in that the heat treatment process was to quickly heat at a heating rate of 25°

C./min to 725° C. and preserve the heat for 25 min, then quickly cool to 600° C. at about 12° C./min and continue to preserve the temperature for 5 h at 600° C.; after the diffusion heat treatment was finished, a sample was cooled in the air to a room temperature.

Embodiment 14

The difference with the embodiment 1 lies in that the heat treatment process was to quickly heat at a heating rate of 25° C./min to 725° C. and preserve the temperature for 25 min, then quickly cool to 650° C. at about 20° C./min and continue to preserve the temperature for 5 h at 650° C.; after the diffusion heat treatment was finished, a sample was cooled in the air to a room temperature.

Embodiment 15

The difference with the embodiment 1 lies in that the heat treatment process was to quickly heat at a heating rate of 25° C./min to 725° C. and preserve the temperature for 25 min, then quickly cool to 600° C. at about 20° C./min and continue to preserve the temperature for 15 h at 600° C.; after the diffusion heat treatment was finished, a sample was cooled in the air to a room temperature.

Comparative Embodiment 1

The difference with the embodiment 1 lies in that the mass fraction of the alloy powder in the mixture was 12%.

The above-mentioned method is employed to detect the magnetic energy product and the coercivity before and after the rare-earth permanent magnetic powder is modified as well as to detect the flux attenuation of the obtained bonded magnet in each embodiment and comparative embodiment, and the detection results are set forth in table 1.

TABLE 1

| | Magnetic energy product (MGOe) | | Coercivity (kOe) | | Flux attenuation (%) | |
|---|---|---|---|---|---|---|
| | Before modification | After modification | Before modification | After modification | Before modification | After modification |
| Embodiment 1 | 15.7 | 15.1 | 7.2 | 11.2 | 6.4 | 2.9 |
| Embodiment 2 | 13.8 | 12.9 | 8.9 | 11.6 | 5.6 | 3.0 |
| Embodiment 3 | 10.5 | 10.0 | 7.3 | 9.2 | 7.8 | 5.9 |
| Embodiment 4 | 15.6 | 15.1 | 9.2 | 11.6 | 5.8 | 2.2 |
| Embodiment 5 | 15.6 | 14.8 | 7.2 | 11.2 | 7.0 | 3.8 |
| Embodiment 6 | 15.5 | 14.9 | 9.3 | 11.5 | 5.4 | 2.7 |
| Embodiment 7 | 15.7 | 14.4 | 7.2 | 10.6 | 6.4 | 3.9 |
| Embodiment 8 | 15.7 | 14.5 | 7.2 | 10.7 | 6.4 | 4.1 |
| Embodiment 9 | 15.7 | 13.5 | 7.2 | 10.2 | 6.4 | 4.3 |
| Embodiment 10 | 15.7 | 14.2 | 7.2 | 11.0 | 6.4 | 3.7 |
| Embodiment 11 | 15.7 | 14.6 | 7.2 | 10.5 | 6.4 | 3.6 |
| Embodiment 12 | 15.7 | 14.3 | 7.2 | 10.6 | 6.4 | 3.8 |
| Embodiment 13 | 15.7 | 14.5 | 7.2 | 10.7 | 6.4 | 3.7 |
| Embodiment 14 | 15.7 | 14.2 | 7.2 | 10.5 | 6.4 | 3.9 |
| Embodiment 15 | 15.7 | 14.5 | 7.2 | 10.6 | 6.4 | 3.6 |
| Comparative embodiment 1 | 15.7 | 12.2 | 7.2 | 18.2 | 6.4 | 1.5 |

It can be seen from the embodiments 1-15 in the table that, by performing the diffusion heat treatment on the corresponding rare-earth permanent magnetic powder by employing the low-melting-point alloy powder provided by the method of the present application and by adopting the heat treatment process provided, the magnetic energy product is slightly reduced, whereas the coercivity is obviously improved. The flux attenuation of the bonded magnet made by the diffusion treated powder is obviously reduced when the magnet in high temperature condition. In addition, compared with the embodiment 1: according to the results of the embodiment 7 and the embodiment 8, it is indicated that the diffusion may be more uniform, and the coercivity and the magnetic energy product may be more appropriate by controlling a granularity ratio, which are also beneficial to the thermostability of the magnetic powder after the corresponding diffusion. It is indicated by the results of the embodiment 9 that the oxidation of the magnetic powder and the diffused source may be controlled by improving the vacuum degree, thereby further improving the magnetic property. The results of the embodiments 10-15 show that the diffused source agglomeration, the grain growth and the like in a heat treatment process can be avoided better by further controlling the temperature heating and cooling rates, the heat treatment temperature and the time in a diffusion heat treatment process, and therefore the magnetic property is further improved. For the results of the comparative embodiment 1, due to excessive addition of the alloy powder, though the coercivity and the thermostability are improved obviously, the magnetic energy product of the magnetic powder is significantly reduced. Furthermore, the rare-earth content is remarkably increased such that the cost of the raw materials is improved, which in turn is not beneficial to the application of the magnetic powder.

In the above description, it can be observed that the embodiments of the present application achieve the following technical effects:

Any one or more of non-heavy rare earths or highly abundant Nd, Pr, Sm, La and Ce rare-earth elements are used in the alloy material of the present application, so the cost is relatively low. One or more of non-rare-earth metal elements in Cu, Al, Zn and Mg are added, and meanwhile, by means of a cooperation of contents, a low-melting-point eutectic alloy may be formed and the liquid phase diffusion may be performed on the eutectic alloy at a relatively low temperature. In addition, with an appropriate addition of one or more elements of low-melting-point metals Ga, In and Sn, the melting point of the alloy material can be further reduced and the wettability between the alloy material and the rare-earth permanent magnetic powder is increased, such that the uniformity of diffusing the elements therein to the rare-earth permanent magnetic powder is improved, the low-temperature diffusion is implemented and the damage to the magnetic property of the magnetic powder due to a high-temperature long-time heat treatment may be avoided. At the meantime, the Ga, the In and the Sn further have the obvious grain boundary segregation characteristic in the neodymium-iron-boron alloy, so that the effect of the grain boundary diffusion to improve the coercivity can be enhanced. Therefore, when the above alloy material of the present application is applied to modifying the rare-earth permanent magnetic powder, the diffusion can be performed at the low temperature and the coercivity of the rare-earth permanent magnetic powder can be enhanced, such that the magnet formed by the modified rare-earth permanent magnetic powder has the relatively good high temperature resistance.

The above description is only preferred examples of the present application and is not intended to limit the present application. For persons skilled in the art, the present application may have various modifications and changes. Any modification, equivalent replacement, or improvement made within the spirit and principle of the present application shall all fall within the protection scope of the present application.

What is claimed is:

1. A modification method of a rare-earth permanent magnetic powder, wherein the modification method comprising:

step S1, mixing an alloy material with a rare-earth permanent magnetic powder to obtain a mixed powder, wherein a mass proportion of the alloy material in the mixed powder is 1-10%, a melting point of the alloy material is lower than 600° C. and a composition of the alloy material by an atomic part is RE100-x-yMxNy, wherein RE is one or more of non-heavy rare-earth Nd, Pr, Sm, La and Ce, M is one or more of Cu, Al, Zn and Mg, N is one or more of Ga, In and Sn, x=10-35 and y=1-15, the alloy material is an alloy powder; and step S2, in a first inert atmosphere or a vacuum state, performing a heat treatment on the mixed powder to obtain a modified rare-earth permanent magnetic powder the step S2 comprises:

step S21, in the first inert atmosphere or the vacuum state, heating the mixed powder for 5-30 min at 675-900° C. to obtain a pretreated powder; and step S22, heating the pretreated powder for 2-12 h at 500-600° C. to obtain the modified rare-earth permanent magnetic powder, before the step S21, the step S2 further comprises: heating at a heating rate not less than 15° C./min to 675-900° C.

2. The modification method as claimed in claim 1, wherein the alloy material is an alloy powder whose granularity is 160-40 μm.

3. The modification method as claimed in claim 1, wherein the vacuum degree of the vacuum state is $10^{-2}$-$10^{-4}$ Pa.

4. The modification method as claimed in claim 1, wherein after the step S21 and before the step S22, the step S2 further comprises: cooling at a cooling rate not less than 15° C./min to 500-600° C.

5. The modification method as claimed in claim 1, wherein a magnetic main phase of the rare-earth permanent magnetic powder is provided with a $RE'_2Fe_{14}B$ structure; wherein, RE' is Nd and/or Pr and parts of the Nd or the Pr therein may be substituted by Dy, Tb, La and/or Ce; a total atomic ratio of rare earths in the rare-earth permanent magnetic powder is 9-12.0%.

6. The modification method as claimed in claim 1, wherein the modification method further comprises a preparation method of the alloy material; the preparation method comprises:

weighing each raw material according to the composition of the alloy material, and preparing the each raw material into a master alloy by employing induction smelting or electric arc smelting;

preparing the master alloy into alloy sheets by employing a strip casting sheet casting method or a melt quenching method; and crushing the alloy sheets into the alloy powder by employing mechanical crushing or hydrogen crushing in a second inert atmosphere, the granularity of the alloy powder being 160-40 μm.

7. The modification method as claimed in claim 1, wherein the mass proportion of the alloy material in the mixed powder is 2-5%.

8. The modification method as claimed in claim 1, wherein a granularity of the rare-earth permanent magnetic powder is 400-50 μm.

9. The modification method as claimed in claim 1, wherein the first inert atmosphere is an argon atmosphere.

10. The modification method as claimed in claim 6, wherein the second inert atmosphere is an argon atmosphere.

* * * * *